United States Patent [19]

Klitsner

[11] Patent Number: 4,932,917

[45] Date of Patent: Jun. 12, 1990

[54] START GATE MARBLE RACE TOY

[75] Inventor: Daniel B. Klitsner, San Francisco, Calif.

[73] Assignee: Discovery Toys, Inc., Martinez, Calif.

[21] Appl. No.: 378,500

[22] Filed: Jul. 11, 1989

Related U.S. Application Data

[63] Continuation of Ser. No. 214,279, Jul. 1, 1988, abandoned.

[51] Int. Cl.[5] ..... A63H 33/00

[52] U.S. Cl. ..... 446/168; 273/86 C

[58] Field of Search ..... 446/168, 170, 171, 172; 273/86 C; D 21/143

[56] References Cited

U.S. PATENT DOCUMENTS

| | | | |
|---|---|---|---|
| 1,374,844 | 4/1921 | Flatow | 273/86 C X |
| 1,546,209 | 7/1925 | Curtiss | 273/86 C |
| 2,726,869 | 12/1955 | Schulte | 273/86 C |
| 2,838,870 | 6/1958 | Morse | 446/168 |
| 3,379,440 | 4/1968 | Jaffe | 273/86 C |
| 3,451,678 | 6/1969 | Gehrts | 273/86 C |
| 3,946,516 | 3/1976 | Wirth | 446/168 |
| 4,153,250 | 5/1979 | Anthony | 273/86 C |
| 4,249,733 | 2/1981 | Eddins et al. | 273/86 C |
| 4,713,038 | 12/1987 | Wichman et al. | 446/168 |

FOREIGN PATENT DOCUMENTS

| | | | |
|---|---|---|---|
| 341120 | 7/1904 | France | 446/168 |

*Primary Examiner*—Mickey Yu

*Attorney, Agent, or Firm*—Townsend and Townsend

[57] ABSTRACT

A marble race toy (4) for use with a marble race game (2) of the type in which a marble (6) moves along a tortuous path. The toy is used for simultaneously starting a plurality of marbles rolling through the game and includes an upper element (8) for holding and retaining the marbles therein which is spaced above a center section (10) connecting the path from the upper element to a funnel-shaped surface (24) for allowing the marble to pass therethrough. The upper element pivots (28, 32) on the center section to begin the marbles rolling through the game. The center section includes a first surface (14) inclined upwardly toward the upper element which is continuous with the funnel-shaped surface.

12 Claims, 2 Drawing Sheets

START GATE MARBLE RACE TOY

This is a continuation of application Ser. No. 214,279 filed July 1, 1988, now abandoned.

BACKGROUND OF THE INVENTION

Marble race games, in which a marble rolls along a tortuous path, have been developed and are enjoyable to watch. Modular constructions allow the user to construct different configurations. Children and adults alike are amused as their eyes follow the marble along the tortuous path which they have constructed.

Marble race games using ramps and tubular connectors are well-known. For example, U.S. Pat. No. 3,946,516 to Wirth discloses a game including only two distinct elements: a connecting tube and a track. The marble drops down the middle of the connecting tube to transfer its movement from one path to another from the top of the course to its bottom. Similarly, U.S. Pat. No. 2,838,870 to Morse discloses identical runways for interengagement of an extended course. The marble travels from the top of the course from one ramp to another until it reaches the bottom.

U.S. Pat. No. 4,713,038 to Wichman et al has been developed by the assignee of the present application and is herewith incorporated by reference thereto. Wichman et al discloses a variety of marble race toys having different configurations for altering the characteristics of travel as the marble passes through each toy, varying the rolling speeds and lengthening the time it takes for each marble to course through the game. Wichman et al includes a number of modular race toys constructed for connection to one another so that a marble passes from the exit of one marble race toy to the entrance of another, downstream marble race toy. All the marble race toys keep the marble moving at a great enough rolling speed to maintain visual interest and yet increase the amount of time it takes to course the entire route of the game. This is done in many of the individual toys of the Wichman et al patent by extending the path along which the marble rolls, or otherwise increasing the time it takes to traverse an entire marble race toy.

Other marble race toys have been created by the present inventor, including those described in applications entitled "Banked Hairpin Marble Race Toy," U.S. patent application Ser. No. 214,243, and "Jump Chute Marble Race Toy," U.S. patent application Ser. No. 214,239 each filed concurrently herewith and assigned to the assignee of the present invention, the disclosures of which are herewith incorporated by reference.

In most of the prior art race games, the marbles begin to traverse the course when the user starts one marble at a time from a beginning region. In one prior art device in which marbles traverse a single track from the beginning to the end of the course, more than one marble rests at the top of the track behind an arm which is lifted, thereby allowing the marbles to begin their path down the track. This device, however, begins the traverse of the marbles from a rest position with no initial momentum.

SUMMARY OF THE INVENTION

The present invention is directed to a marble race toy for beginning the simultaneous traverse of a plurality of marbles starting with an initial momentum. This increases the excitement derived while observing the marbles travel through the course. For ease of reference, a marble, as herein defined, is considered any object which is capable of rolling along the tortuous path of the groove and therefore could be cylindrical or oval as well as spherical.

The marble race toy includes a modular construction for connecting to a different toy of the game so that a marble passes from the exit of one marble race toy to the entrance of another, downstream toy. The marble race toy begins travel of the marbles with a great enough rolling speed to maintain visual interest while watching the marbles traverse varying paths of the marble race game.

The marble race toy of the present invention is preferably connected as the uppermost toy in the marble race game and is used as a starting gate. A plurality of marbles are retained in an upper element until the race begins. The upper element is positioned vertically above and spaced apart from a center section. The marble race toy includes a pivot for pivoting the upper element on the center section. As the upper element is pivoted to begin the race, gravity imparts a starting velocity to the marbles as they fall the spaced distance from the upper element to the center section.

The center section, in the preferred embodiment, includes an inclined surface adjacent the pivot and upper element. The inclined surface may include diverting elements, such as projections, which deflect the marbles as they roll along the center section.

The center section preferably directs the marbles toward a columnar member having a funnel-like section having a vortex-shaped surface and a hollow interior. The marbles pass through the hollow interior of the columnar member so as to traverse the remaining toys in the marble race game.

The upper element is configured to retain the marbles until pivoted to begin travel of the marbles along their path. The marbles are preferably held parallel to and separated from each other in the upper element by generally vertical walls. The walls maintain the marbles within lanes until the traverse of the marbles through the marble race game begins.

Other features and advantages of the invention will appear from the following description in which the preferred embodiment has been set forth in detail in conjunction with the accompanying drawings.

DETAILED DESCRIPTION 0F THE PREFERRED EMBODIMENT

Figure 1:
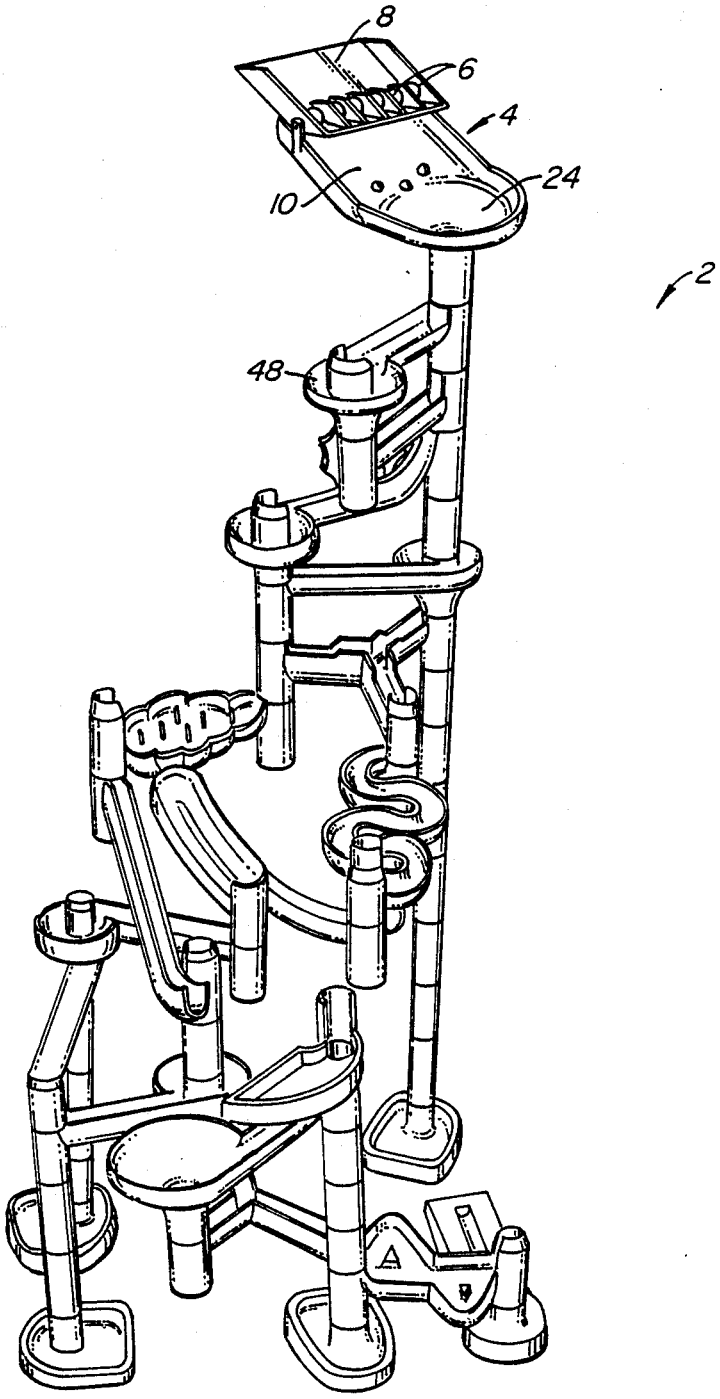
FIG. 1 is an overall perspective view of a marble race game including the marble race toy of the present invention.

Referring now to the drawings, FIG. 1 illustrates the marble race game 2 constructed to include a marble race toy 4 uppermost in the tortuous path in which marble 6 travels.

The arrangement of the various toys constituting game 2 may be varied from that disclosed in FIG. 1. The toys other than marble race toy 4 are shown for environmental purposes only and do not constitute a part of this invention. They will, therefore, not be described in detail in this application.

Figure 4:
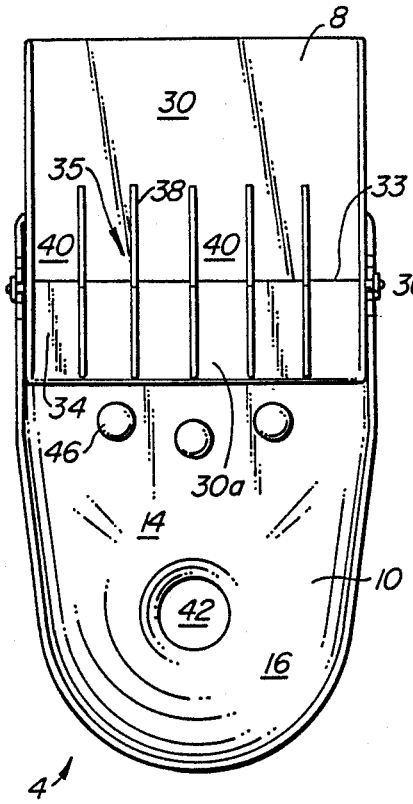
FIG. 4 is a top view of the marble race toy of FIGS. 2 and 3.
Figure 2:
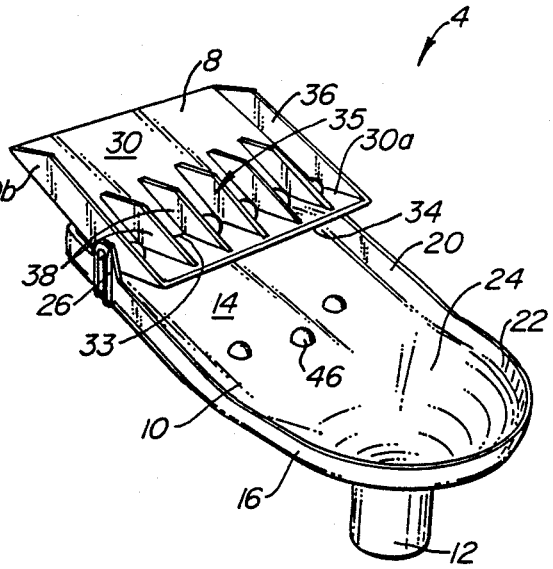
FIG. 2 is a perspective view of the marble race toy of the present invention.
Figure 3:
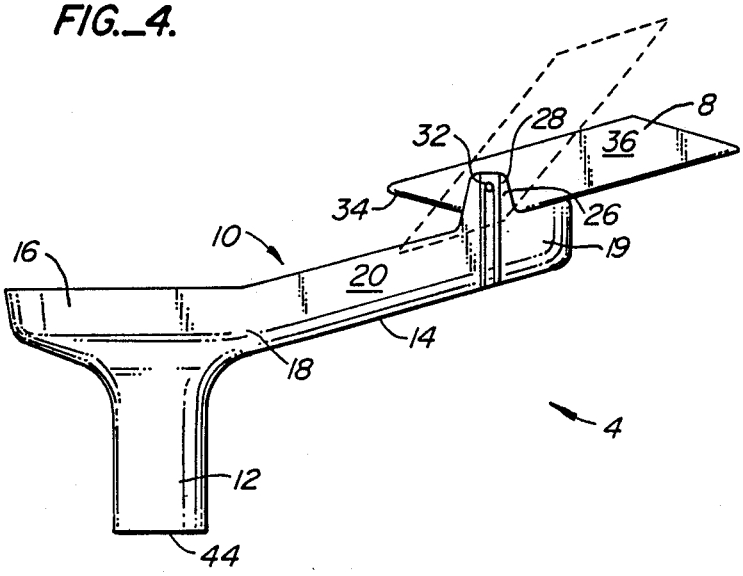
FIG. 3 is a side view of the marble race toy of the marble race toy of FIG. 2.

Referring now also to FIGS. 2–4, marble race toy 4 includes an upper element 8, a center section 10, above which element 8 is pivotally mounted, and a funnel 24. Funnel 24 is secured to the opposite end of the center section from upper element 8.

Center section 10 includes an inclined surface 14. Funnel 24 is secured to center section 10 at a lower end 18 of surface 14. Funnel 24, comprising a vortex-shaped surface 16 and a columnar member 12, is continuously formed with a lower end 18 of inclined surface 14. Sidewalls 20 completely surround an outer edge 22 of inclined surface 14 and vortex-shaped surface 16.

Upper element 8 includes a supporting surface 30 for supporting marbles 6. Pivots 32 extend from upper element 8 and are received in openings 28 of extensions 26 of sidewalls 20. Pivots 32 comprise pins secured to upper element 8 received in opening 28. It would be within the scope of the invention to provide alternate pivot constructions, for example, to provide pins secured to extensions 26 and received in openings of the upper element. Pivot 32 is located toward a front end 30*a* of upper element 8 so that supporting surface 30 overlies upper end 19 of inclined surface 14.

Front lip surface 34 intersects supporting surface 30, forming an obtuse angle at intersection 33. Upper element 8 includes two sidewalls 36, each positioned perpendicular to both supporting surface 30 and front lip 34 and defining a trough- shaped region 35 therein. Pivots 32 extend outwardly from the outer surfaces of sidewalls 36 approximately along intersection 33. Walls 38 are positioned parallel to and intermediate sidewalls 36. Walls 38 are also perpendicular to both supporting surface 30 and front lip 34, dividing trough-shaped region 35 into lanes 40, each slightly wider than the diameter of marbles 6. Columnar member 12, constituting the bottom portion of funnel 24, includes hollow interior channel 42 defining bottom exit 44. Member 12 mates with the next downstream toy, such as J-loop toy 48 in FIG. 1, of marble race game 2 to allow marbles 6 to continue along the tortuous path of marble race game 2.

Inclined first surface 14 of center section 10 includes rounded protrusions 46 for diverting the path of marbles 6 through the center section. Protrusions 46 could be constructed in forms other than rounded protrusions, for example, as rounded depressions or as wedge-shaped protrusions.

In use, marbles 6 rest within the trough-shaped region of upper element 8 at intersection 33 of supporting surface 30 and front lip 34. Marbles 6 are placed within lanes 40, positioning the marbles to start their tortuous path through race game 2. Upper element 8 pivots about pivots 32 for beginning the traverse of marbles 6 with an initial momentum. As upper element 8 is pivoted, the effects of gravity impart an initial speed to marbles 6. Marbles 6 roll from upper element 8 into center section 10, along incline surface 14, around protrusions 46 and onto generally horizontal vortex surface 16 of funnel 24. Marbles 6 roll in a downward spiral fashion over vortex surface 16 and finally down into hollow interior channel 42 of columnar member 12. Marbles 6 then pass through toy 4 and through exit 44 to traverse successive toys of game 2.

Although marble race toy 4 has been described as a starting gate, it could be modularly constructed within game 2 in other positions, for example, to catch marbles as they roll through the jump chute of the application entitled "Jump Chute Marble Race Toy," referred to above. In addition, a single marble may be place in upper element 8 to begin its tortuous path through marble race game 2.

Because upper element 8 is spaced above center section 10, marbles 6 begin rolling with an initial momentum, increasing the starting speed of the marble as it traverses the tortuous path through marble race game 2. This increases the speed and interest of the game.

Modification and variation can be made to the disclosed embodiment without departing from the subject of the invention as defined by the following claims.

I claim:

1. A marble race toy for use with a marble race game of the type in which a marble moves along a tortuous path comprising:

an upper element for retaining at least one marble;

pivot means including a pivot axis for starting the marble rolling along a path from the upper element through the game;

a funnel-like section having a vortex surface and central exit defining a hollow interior for allowing the marble to pass therethrough; and a center section, coupling the upper element and the funnel-like section, including an inclined surface for directing the marble toward the vortex surface;

wherein said pivot means pivots the upper element on the center section about said pivot axis, said pivot axis being fixedly spaced above the center section.

2. The toy as defined in claim 1 wherein the upper element is spaced above the center section.

3. The toy as defined in claim 1 wherein the upper element includes a front lip surface for retaining the marble until it is started along its path.

4. The toy as defined in claim 1 wherein the upper element and the center section each include side walls for retaining the marble within the respective upper element and center section.

5. The toy as defined in claim 1 wherein the center section includes an opening for allowing passage of the marble through the exit means.

6. The toy as defined in claim 1 wherein the upper element includes means for separating the marbles and holding them in generally parallel alignment with each other.

7. The toy as defined in claim 6 wherein the upper element includes a surface for supporting the marble and wherein the means for separating the marbles includes a plurality of walls extending generally perpendicular to the surface of the upper element.

8. The toy as defined in claim 6 comprising at least one means for diverting the marble within the center section.

9. The toy as defined in claim 1 wherein said means for starting the marble rolling is configured to direct the marble from each marble position toward the vortex surface in a random manner such that said means for starting the marble rolling imparts equal advantage so that each marble has equal probability to be the marble to first reach the vortex surface.

10. A marble race toy for use with a marble race game of the type in which a marble moves along a tortuous path, the toy for starting a plurality of marbles rolling through the game along a tortuous path comprising:

a center section for receiving the marbles to direct the marbles rolling through the game along the tortuous path;

an upper element for retaining the marbles therein, including means for holding the marbles generally laterally aligned on a surface positioned directly above and spaced apart from the center section;

a pivot having an axis fixedly spaced above the center section for pivotally connecting the upper element on the center section so to begin the marbles rolling through the center section;

the center section including a first surface having an inclined surface; and a second surface continuous with the first surface and wherein the second surface further comprises a generally funnelshaped element such that marbles roll from the upper element, along the inclined first surface, around the second surface and through the game.

11. The toy as defined in claim 10 wherein the center section couples the upper element and the funnel-like section.

12. A marble race toy for use with a marble race game of the type in which a marble moves along a tortuous path, the toy for starting a plurality of marbles rolling through the game along a tortuous path comprising:

a center section for receiving the marbles to direct the marbles rolling through the game along the tortuous path;

an upper element for retaining the marbles therein, including means for holding the marbles generally laterally aligned on a surface positioned directly above and space apart from the center section;

a pivot having an axis fixedly spaced above the center section for pivotally connecting the upper element on the center section so to begin the marbles rolling through the center section;

the center section including a first surface having an inclined surface; and a second surface continuous with the first surface wherein the second surface generally comprises a funnel-shaped element.

* * * * *